United States Patent [19]

Spengler

[11] 4,100,844

[45] Jul. 18, 1978

[54] BOX BLANK PUNCHING TOOL

[75] Inventor: Ernst M. Spengler, Heusenstamm, Fed. Rep. of Germany

[73] Assignee: R & S Stanzformen GmbH, Bergen-Enkheim, Fed. Rep. of Germany

[21] Appl. No.: 697,747

[22] Filed: Jun. 21, 1976

[30] Foreign Application Priority Data

Jun. 23, 1975 [DE] Fed. Rep. of Germany ... 7519878[U]
Oct. 15, 1975 [DE] Fed. Rep. of Germany ..... 2546082

[51] Int. Cl.[2] ..... B31B 1/20
[52] U.S. Cl. ..... 93/59 ES; 93/58.3
[58] Field of Search ..... 93/59 ES, 59 R, 58.3, 93/58.4, 58.5, 58 R, 58 ST, 58.2 F

[56] References Cited

U.S. PATENT DOCUMENTS 2,586,744 2/1952 Troth ..... 93/58.3
3,170,342 2/1965 Downie ..... 93/58.2 F
3,289,516 12/1966 Bohrer et al. ..... 76/107 C X
3,292,513 12/1966 Palmer ..... 93/58 R

*Primary Examiner*—James F. Coan
*Attorney, Agent, or Firm*—W. G. Fasse; W. W. Roberts

[57] ABSTRACT

Precision male and female dies with the respective tool for manufacturing folding box blanks, are produced by photographic reproduction processes. The contour and the fold lines of a particular box blank are first drawn as an original on a light transparent film. This original forms a standard blank or standard film which is then used to produce an image of the punching knife location and of the positions of the embossing line projections on the male die. The same original is also used to produce an image of the respective groove configurations in the female die. The punching knives are then inserted into a support plate in accordance with these images. Similarly the grooves and embossing lines are produced in accordance with the respective images.

6 Claims, 9 Drawing Figures

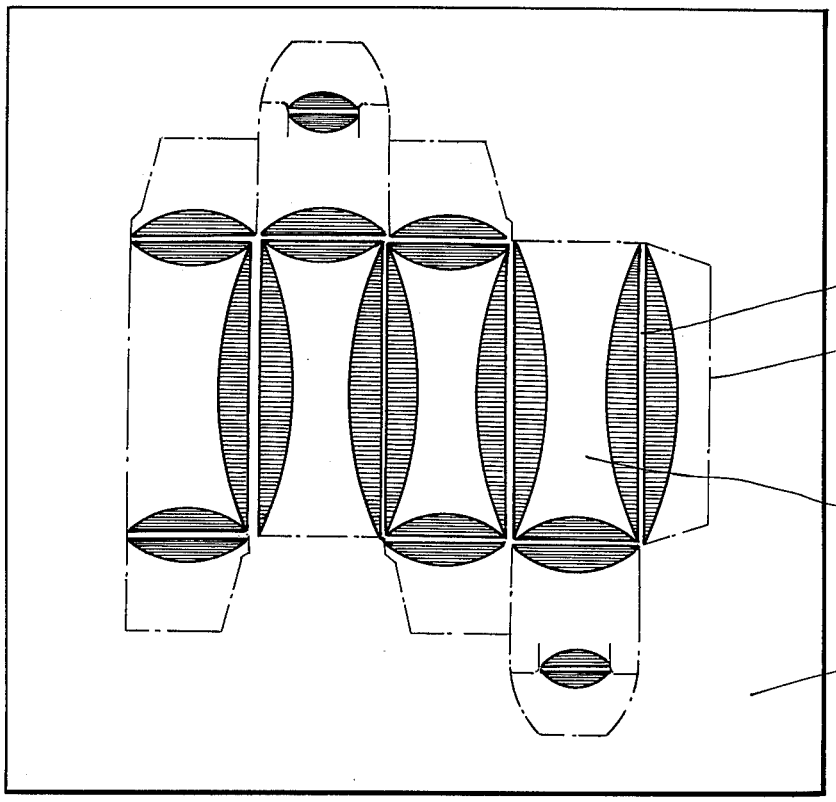
Fig.3
Fig.4
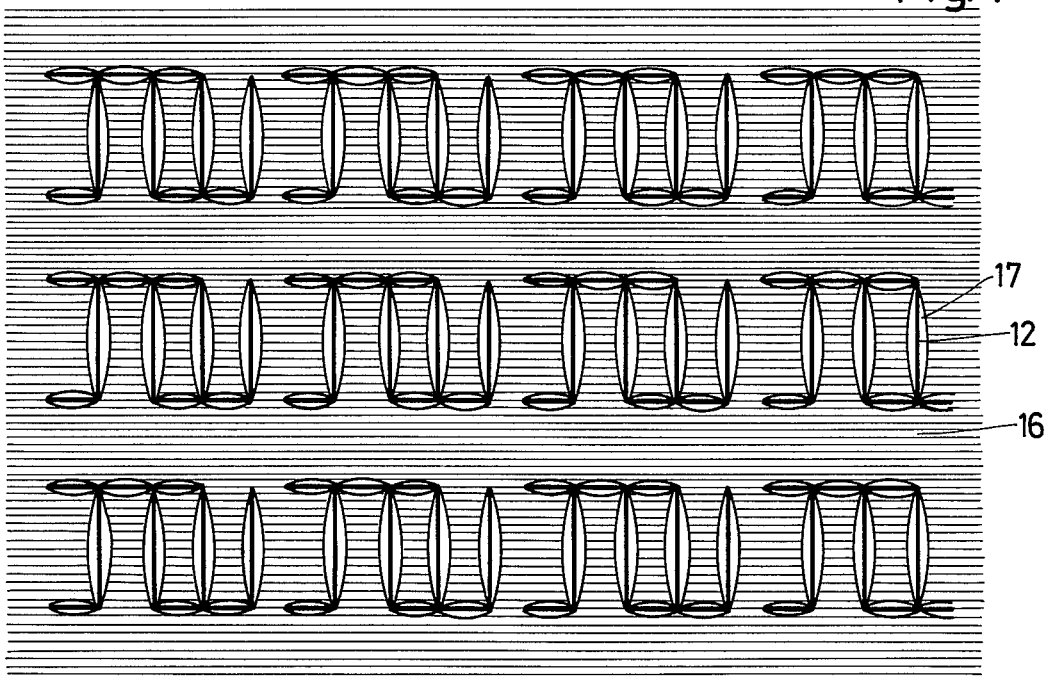

BOX BLANK PUNCHING TOOL

BACKGROUND OF THE INVENTION

The invention relates to a punching tool for folding boxes as well as to a method for its production.

Heretofore it was customary that the manufacturer of punching tools intended for the punching of boxes, merely manufactured the punch or male die with the punching knives and the embossing projections. It was also customary that the customer then produced himself the corresponding female or bottom die with the aid of the male die delivered to him. The reason for this approach is seen in the dimensional tolerances which were to be met in the punching and embossing of folding boxes. Such dimensional tolerances were to be maintained because the printing sheets serving as a starting material must frequently be imprinted by the manufacturer of the folding boxes by a multi-color printing in addition to the stamping and embossing.

OBJECTS OF THE INVENTION

It is the object of the invention to provide a method which enables the manufacturer of the male die comprising the punching knives, to also manufacture the female die with the highest accuracy.

SUMMARY OF THE INVENTION

For solving this problem or achieving this objective there is provided according to the invention that first a standard blank of precise dimensions or a standard film is produced. Stated differently, the contour and the folding lines of the holding box are drawn as a developed projection onto a light transmissive or transparent foil or on a first, exposed and developed film negative. This original or standard film is then copied and a punching knife film or a punching knife location image, hereinafter referred to as a knife image, are produced. With the aid of these knife images the punching knives are then arranged on the male die. Further, an embossing line negative and a notch or groove line negative are produced by means of optical printing from the original or standard film. The precise widths of the embossing projections on the male die and the width of the grooves or notches in the female die are notched into these negatives. An embossing line film and a groove or notched line film are then produced from the so-treated embossing line negative and groove line negative whereby multi-copying is employed. Finally plates coated with a light sensitive layer are exposed after interposing the embossing line film or the groove line film and the exposed portions of the plate are then washed off for producing the embossing projections on the male die and the grooves in the female die.

By using the different films one achieves the highest possible accuracy and the smallest tolerances may be maintained because the location of the punching knives as well as the location of the embossing projections on the male die or the position of the grooves in the female die are determined with the aid of the film material serving as a masking which originates from the single original or standard film due to the optical printing and copying. Thus, the manufacturer of the male die now has the possibility to arrange the punching knives and the embossing projections on the male die with absolute accuracy and to manufacture a female die fitting with certainty to the respective male die.

Further features of the invention are disclosed in the specifications and the claims in conjunction with the drawings.

BRIEF FIGURE DESCRIPTION

The invention will be described in more detail in the following with reference to an example embodiment which is illustrated in the drawings. These drawings show:

FIG. 1 a standard blank or original film for a folding box in its natural size;

FIG. 2 a punching knife film on a reduced scale;

FIG. 3 a scored foil or an embossing line negative for the male die in its natural size;

FIG. 4 an embossing line film on a reduced scale;

FIG. 5 a scored or notched foil or a groove line negative for the female die in its natural size;

FIG. 6 an original or standard groove line film in its natural size;

DETAILED DESCRIPTION OF PREFERRED EXAMPLE EMBODIMENTS

Figure 1:
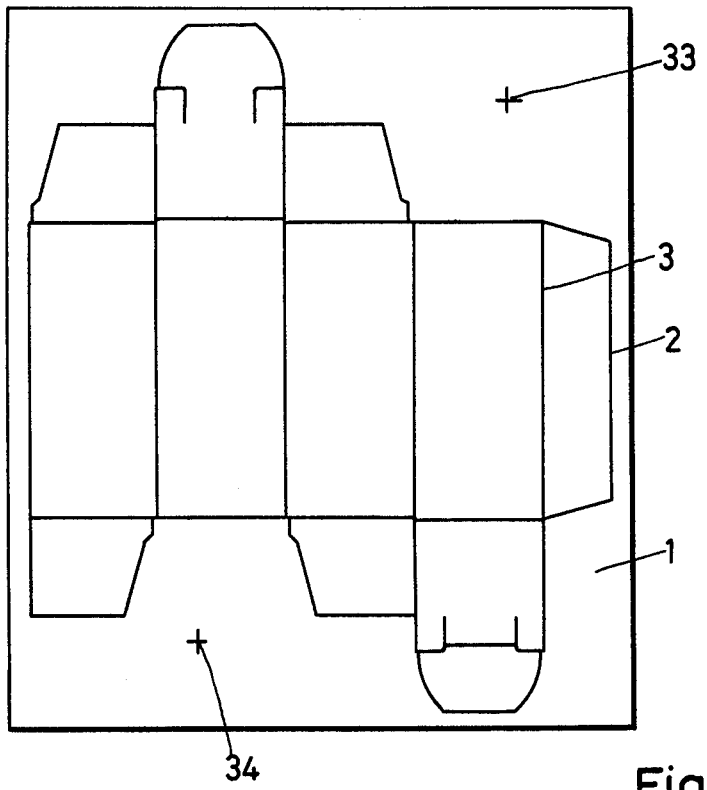
Figure 2:
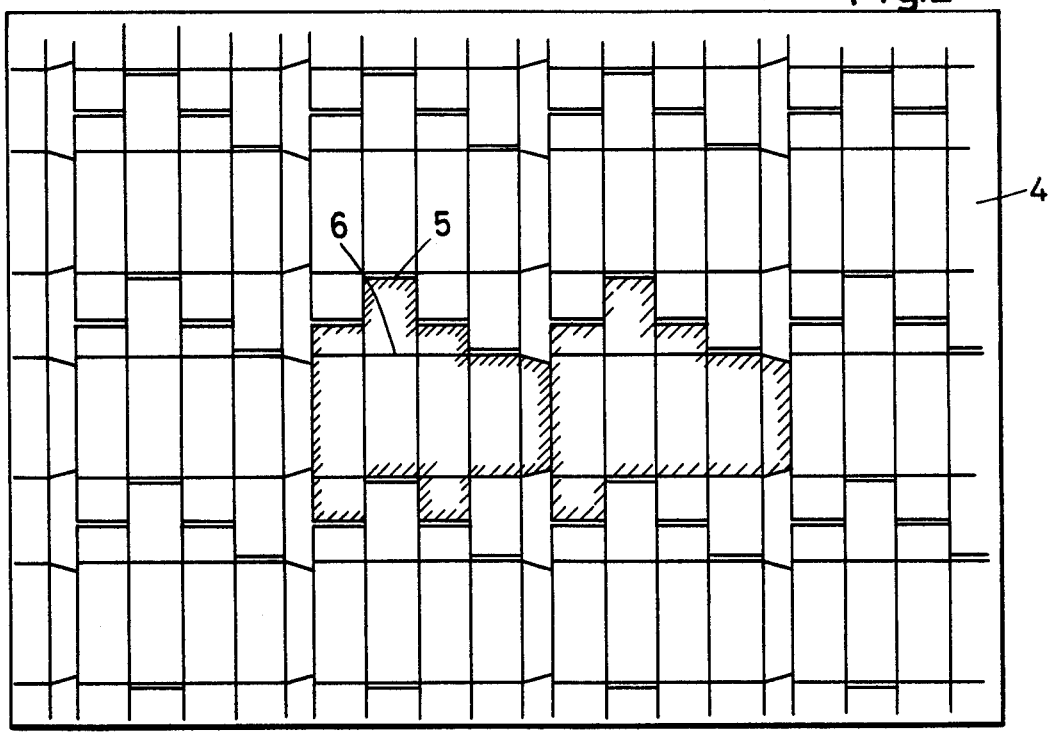

In connection with the production of a punching tool for a folding box the shape and size of which is given, first a standard blank or standard film is drawn according to FIG. 1. Stated differently, the contour 2 of the several folding lines 3 of the folding box are applied in the form of a developed projection onto a light transparent foil or to a first, exposed and developed film negative. This may be accomplished by means of a suitable mechanical device. The standard film 1 serves for producing a punching knife film 4 or a punching knife location image. This punching knife film 4 may be produced by using a copier or duplicator apparatus whereby the image on the standard film 1 is transmitted in its natural size onto a respectively large film negative the desired number of times and in a manner so as to save space. The image of the contour lines 5 and the folding lines 6 on the punching knife film 4 is transferred onto a light sensitive paper by way of an exposure. The punching knives 7 are then arranged and secured in a base plate 8 of a male die 9 according to FIG. 9 with the aid of said paper.

Further, an embossing line negative 10 and a groove line negative 11 are produced from the standard film 1 by means of optical printing. Optical printing in this context means that the dark contour and folding lines of the standard film become light and the remaining surface becomes dark.

Embossing lines 12 are then scored into the embossing line negative 10 with the desired width and with great accuracy by removing the black film layer.

The groove lines 13 are scored into the groove line negative in the same manner. Instead of the conventional solid negative material it is possible to use for this purpose a scoring foil having an especially thick layer.

The width of the embossing lines or of the groove lines is selected in accordance with the thickness of the paper material which is used for making the folding box. Further, the groove lines are as a matter of principle somewhat wider than the embossing lines.

Figure 5:
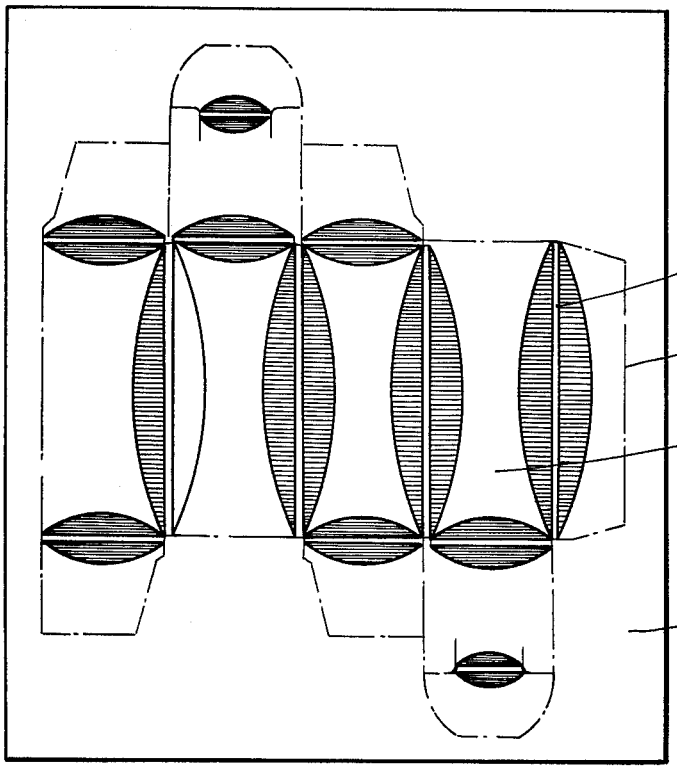

The film layer material 14 or 15 between the embossing lines 12 and the groove lines 13 may be removed in an arcuate shape in the manner shown in FIGS. 3 and 5. However, this is not absolutely necessary. It is suitable to mask the contour lines 5 which are indicated in FIGS. 3 and 5 by dash dotted lines, but this is also not absolutely required.

Subsequent to the processing of the embossing line negative 10, it is used for producing an embossing line film 16 by optical printing and duplicating in a copier and duplicator apparatus whereby the embossing line film 16 corresponds to the punching knife film 4 with regard to position and number. The embossing lines 12 are black on the embossing line film 16 which is used for directly producing the embossing projections on the male die, whereas the surface area 17 which forms the boundaries of the embossing lines 12 are light or light transparent.

Figure 6:
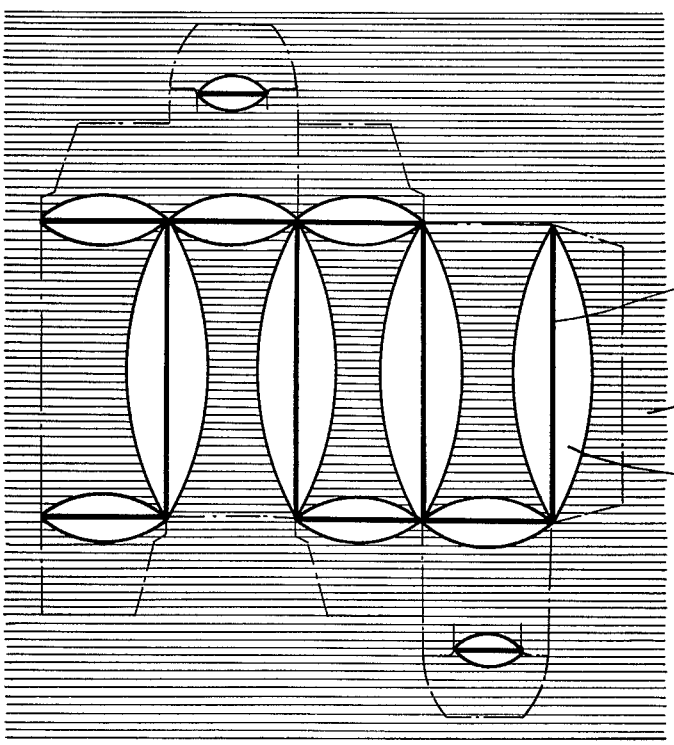

A groove line standard film 18 is produced first from the groove line negative 11 by means of optical printing. Stated differently the groove lines 13 are now dark as shown in FIG. 6 whereas the surface areas 19 which bound the groove lines 13, are light. The groove line standard film 18 serves for producing a groove line film not shown in the figures, however, which corresponds substantially to the embossing line film 16 as shown in FIG. 4 except for the width of the lines and except for the respectively different color black or white. Plates 25 or 26 are used for producing the embossing projection 20 on the male die 9 and the grooves 21 in the female die 22 according to FIG. 9. These plates 25 or 26 are coated with a light sensitive layer 23 or 24 and these layers are exposed through the intermediary of the embossing line film 16 or the groove line film. After the exposure the exposed portions of the plates are washed off. The exposure is accomplished by means of ultraviolet or infrared light and an alcohol solution is used for said washing. The type of exposure is as well as the solution used for the washing are selected in accordance with the light sensitive layer of synthetic material.

After the washing of the exposed portions the areas not exposed remain as projections 24. In the case of the male die 9 these projections 24 serve as embossing members 20 whereas in the female die 22 the projections form the boundaries of the grooves 21.

The plates 25 or 26 which are coated with the light sensitive layer 23 or 24 are thin steel or aluminum plates. The plate 25 with the grooves 21 is secured in the punching apparatus to the counter pressure plate by means of an adhesive. Suitably this may be done when the male die 9 is secured to the pressure plate of the punching apparatus. For this purpose the female die 22 is placed on the installed male die 9 whereupon the punching apparatus is actuated to move the dies together. It is also possible to insert the male die 9 and the female die 22 as a sandwich packet into the open punching apparatus. Thereafter when the members of the punching apparatus move toward each other during the closing the male die and the female die are glued to the pressure plate or to the counter pressure plate.

The base plate 8 of the male die 9 is, for example, made of wood provided with slots 27 sawed into the wood. The slots are interrupted by bridges and the sawing is accomplished in accordance with the location of the contour lines 5 on the punching knife film 4 or in accordance with the knife image. After the insertion or hammering of the punching knives 7 they extend above the base plate 8 by an entirely determined amount. During the sawing of the slots 27 into the base plate 8 in accordance with the knife image a portion 28 of the plate is cut out in a congruent manner or simultaneously. Such portion 28 is part of the plate which was produced with the aid of the embossing line film 16. Therefore, this plate portion 28 has the outer dimensions or a contour 29 which is congruent without play with the inner contour 30 of the punching knife 7 or the punching knives 7.

The embossing projections 20 are arranged on the plate 26 or on the plate portion 28 as a unit. The plate 26 or the portion of the plate 28 is supported and held by the base plate 8 whereby an elastic material 31 is interposed therebetween. The material 31 is preferably a rubber having a suitable elasticity. The thickness of this layer like elastic material 31 is selected so that the embossing projections 20 extend above the plane in which the knife edges 32 of the punching knives 7 are located. Relative to FIG. 9 this means that the embossing projections 20 extend further downwardly than the cutting edges 32. Thus, the plate 26 with its projection 20 is capable to serve simultaneously as an ejector for the punched out material.

The plate 26 or the plate portion 28 is arranged between the punching knives 7 without play. As clearly shown in FIG. 9, the punching knives 7 have a reduced cross section 32' immediately adjacent to the chamfers forming the cutting edge 32. This reduced cross section 32' is provided in order to achieve a free movement of the plate 26 or the plate portion 28 in accordance with the spring support in spite of the fact that there is no play between the knives 7 and the plate 26 or the plate portion 28. Preferably the punching knife cross section is reduced in a symmetric manner in order to achieve a uniform loading of the material of the punching knives. The degree in the reduction of the cross section of the punching knives 7 depends on the required movability of the plate 26 or the plate portion 28 and the reduction in cross-section is not larger than absolutely necessary.

The plate portion 28 may be sawed out from a large plate which was produced with the aid of an embossing line film 16 which has embossing lines 12 for many folding boxes. Basically however, it is also possible to saw the plate portion 28 from a plate on which there are only the embossing projections 20 for a single folding box. Such a plate is produced with the aid of an embossing line film which is directly optically printed from the embossing line negative 10 of FIG. 3.

Whereas the plate 25 which was produced with the aid of the groove line film and which comprises grooves 21 contains the grooves for several folding boxes, the plate 26 which was produced in the same manner may comprise either only the embossing projections of one folding box or this plate must be cut into several plate portions 28 as described above. These plate portions are then arranged respectively between the punching knives for the several folding boxes whereby the plates are spring biased in the punching direction.

Just as it is possible to transfer the precise position of the contour and folding lines from the standard film 1 onto the embossing line film 16 and the groove line film, it is also possible to provide centering markers 33 or 34 on the standard film 1 or on one or the other negative or film which markers are then respectively duplicated. These makers 33 and 34 appear eventually also in the light sensitive layer 23 or 24 on the plates 25 and 26 and define exactly the position for centering pins 35 and 36 which may be used if desired as shown in FIG. 9, or at 37 in FIGS. 7 and 8.

Figure 7:
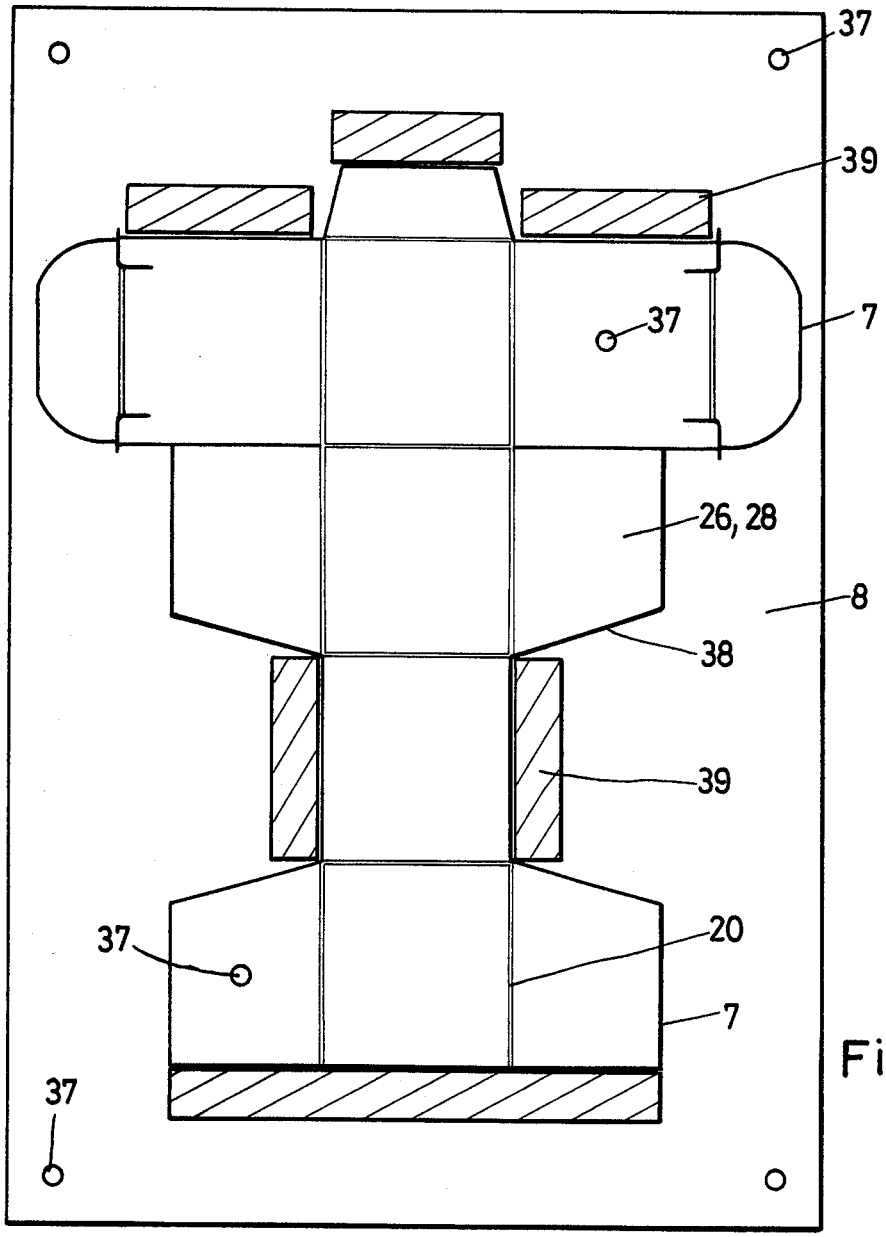
FIG. 7 is a plan view of a simple male die for another folding box.
Figure 8:
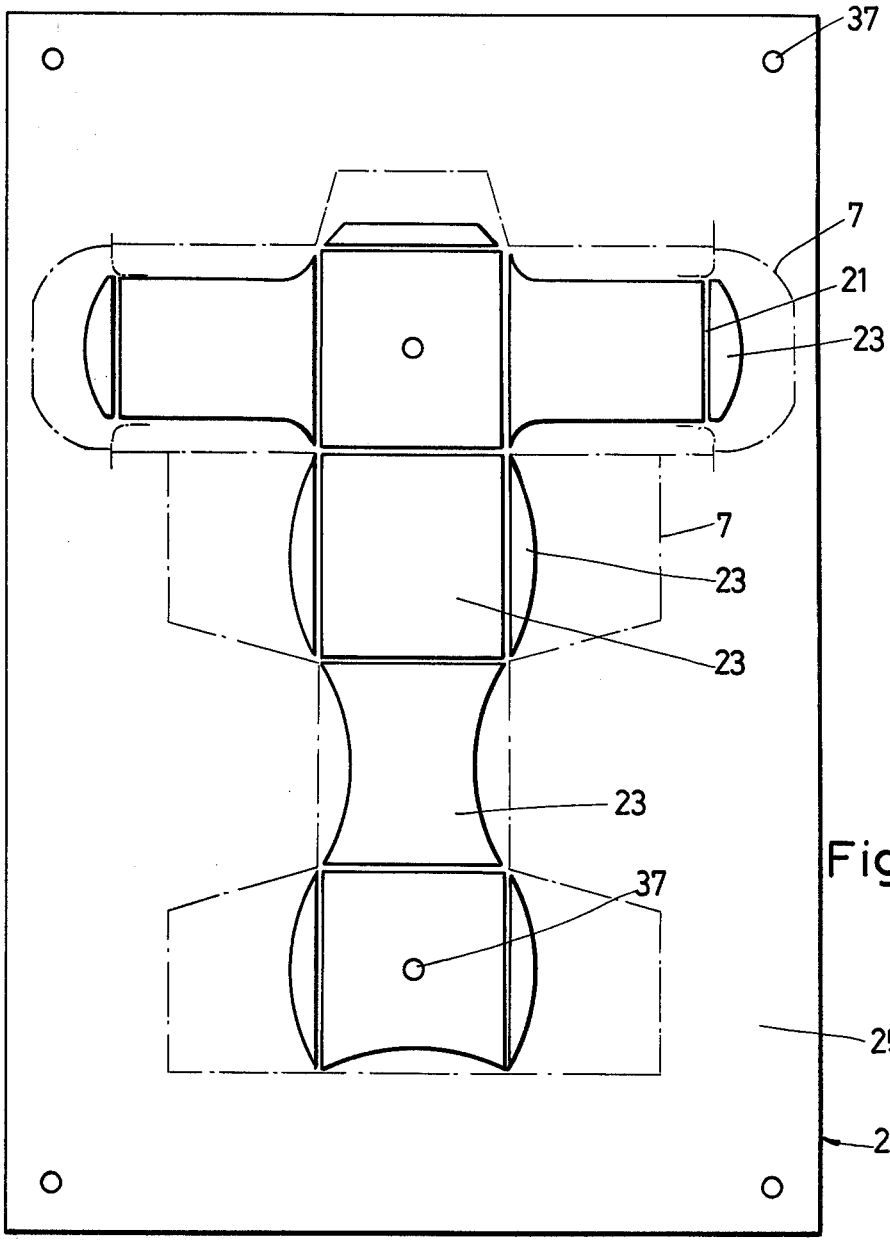
FIG. 8 is a plan view of the simple female die of the folding box according to FIG. 7.
Figure 9:
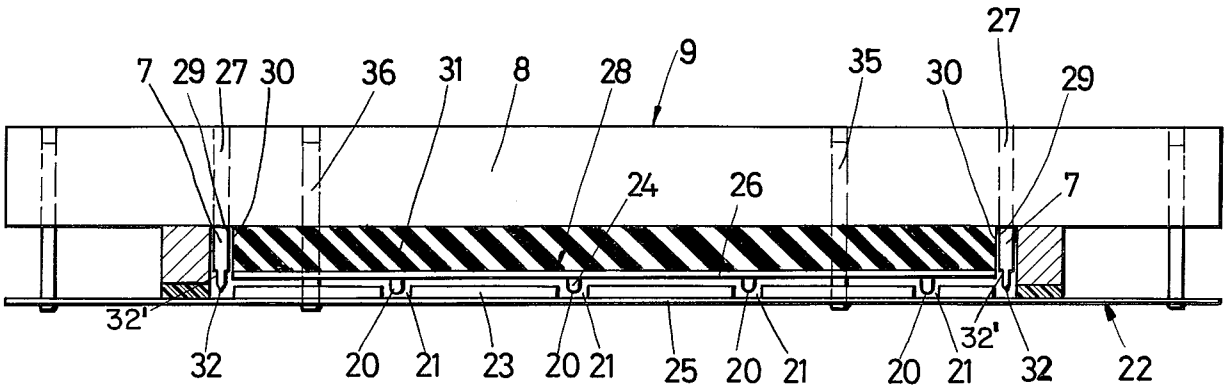
FIG. 9 is a sectional view through a male and female die according to the invention.

The two FIGS. 7 and 8 show plan views of a punching tool for a single folding box and comprising a male die and a female die. A plurality of rubber buffers 39 is arranged at the outer contour 38 of the punching knives 7. These buffers 39 serve as ejectors just as the plate 26.

The invention is not limited to the example embodiment shown in the figures, rather it is possible to make modifications without departing from the basic teaching of the invention.

I claim:

1. In a punching tool for making folding box blanks, including a male die member having a support base plate with punching knives secured to said support base plate, said punching knives defining the contours and cut lines of said blanks, with embossing projections also supported by said support base plate, and with a female die member with grooves therein arranged for cooperation with said male die member, the improvement comprising embossing plate means, said embossing projections extending from said embossing plate means in the same direction as said punching knives, said embossing plate means being movably held by said support base plate within the contour defined by said punching knives, elastic means interposed between said embossing plate means and said support base plate so that said embossing projections extend beyond the plane defined by the cutting edges of the punching knives when the elastic means are uncompressed, said female die member comprising a female plate member with raised fields thereon, said raised fields being spaced from each other to define said grooves which cooperate with said embossing projections, said punching knives comprising chamfers forming a cutting edge proper and a portion of uniform and reduced cross-section immediately adjacent to said chamfers forming the cutting edge proper, said reduced cross-section permitting the free movement of said embossing plate means, said elastic means comprising a compressible rubber elastic layer interposed between said embossing plate means and said support base plate, whereby the embossing plate means serves as an ejector when said rubber elastic layer expands after it has been compressed.

2. The punching tool of claim 1, wherein said embossing projections are portions of an unexposed photosensitive material bonded to the surface of said embossing plate, and wherein said raised fields on said female plate member are also portions of an unexposed photosensitive material bonded to the surface of said female plate member outside said grooves.

3. The punching tool of claim 1, wherein the embossing plate means (26, 28) has an outer contour (30) with such dimensions that said outer contour (30) is congruent with the inner contour (29) of the punching knives substantially without any play.

4. The punching tool of claim 1, wherein the reduced cross section of the punching knives is symmetrical relative to a plane extending centrally through said punching knives.

5. The punching tool of claim 1, wherein said embossing plate and said female plate member each comprise a steel or aluminum plate having initially laminated thereto a light sensitive, etchable layer of synthetic material, which light sensitive, etchable layers have been exposed in the areas to be removed outside said embossing projections on the embossing plate and outside said raised fields on the female plate member to form said grooves.

6. The punching tool of claim 1, wherein said embossing plate or plates comprises a plurality of embossing projections arranged on said embossing plate or plates.

* * * * *